US006686847B1

(12) United States Patent
Mittler

(10) Patent No.: US 6,686,847 B1
(45) Date of Patent: Feb. 3, 2004

(54) INDICATOR WITH DAYLIGHT VISIBILITY USING A SINGLE LIGHT EMITTING DIODE

(75) Inventor: Jon P. Mittler, Roseville, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/569,813

(22) Filed: May 12, 2000

(51) Int. Cl.[7] ..... G08B 5/00

(52) U.S. Cl. ..... 340/815.4; 340/815.45; 340/815.47; 340/815.49; 340/815.72; 340/525; 345/102; 345/902; 362/800

(58) Field of Search ..... 340/815.4, 815.45, 340/815.47, 815.49, 815.55, 815.73, 525; 345/102, 39, 44, 46, 47, 902; 362/800; 359/529; 313/113, 114, 116

(56) References Cited

U.S. PATENT DOCUMENTS

| | | | | |
|---|---|---|---|---|
| 4,271,408 A | * | 6/1981 | Teshima et al. | 362/800 |
| 4,915,478 A | * | 4/1990 | Lenko et al. | 350/338 |
| 4,975,694 A | * | 12/1990 | McLaughlin | 340/825.44 |
| 5,241,160 A | | 8/1993 | Bashan et al. | 235/380 |
| 5,479,328 A | * | 12/1995 | Lee et al. | 363/216 |
| 6,007,209 A | * | 12/1999 | Pelka | 362/800 |

OTHER PUBLICATIONS

Hewlett–Packard, "Light Guide Techniques Using LED Lamps", Application Brief I–003, 20 pages, Mar. 20, 2000.

Hewlett–Packard, "Selecting LED Lamps for Automotive Interior Applications", Application Note 1100, 21 pages (1997).

Hewlett–Packard, "Using Super Flux LEDs In Automotive Signal Lamps" Application Note 1149–1, 18 pages (1999).

Hewlett–Packard, "LED Stop Lamps Help Reduce the Number and Severity of Automobile Accidents", Application Note 1155–3, 8 pages (1998).

E–Payments 2000: C–Stores Advance Technology, pp. 12A–13A, Jun. 1999.

http://www.gilbarco.com/gilbarco_graphics/guide/3grade2hose.html, Encore Single Hose MPD Dispenser 3 Grade of 3+0 Grade Blender Dispenser, 1 page, May 10, 2000.

Sensormatic Electronics Corporation, RM Series Card Readers, 4 pages (1996).

* cited by examiner

*Primary Examiner*—Donnie L. Crosland

(57) ABSTRACT

A single LED combined with a dark-colored reflective cavity, a diffusing graphic overlay, and a dark tinted window, provides a backlighted indicator with low power requirements. The design exhibits high visual contrast between on and off conditions, giving daylight visibility. The diffusing overlay and the window are nested and individually attached to a housing with adhesives, thus providing a double barrier against liquid penetration. Thus, the indicator can be used outdoors and under conditions of limited power. For example, the indicator may be part of a customer terminal mounted outdoors at retail establishments, such as gasoline stations.

32 Claims, 2 Drawing Sheets

INDICATOR WITH DAYLIGHT VISIBILITY USING A SINGLE LIGHT EMITTING DIODE

TECHNICAL FIELD

This invention relates generally to lighted indicators, and more specifically to backlighted indicators visible in daylight using a single light emitting diode.

BACKGROUND

Numerous modern electronic devices include indicator lights to provide information to a user of the device and to facilitate user interaction with the device. Depending on the application, incandescent bulbs, fluorescent bulbs, or clustered or single light emitting diodes (LEDs) may be used as indicator lights. However, common approaches to indicator lights may not provide satisfactory performance when there is only limited power available to an indicator that needs to be visible in daylight.

One familiar design uses one or more fluorescent or incandescent bulbs positioned behind a window or transparent diffusing overlay printed with indicator graphics. This design is commonly used in gasoline dispensers, "gas pumps" in which, for example, the price for each type of gasoline is shown in a display that is backlighted with incandescent bulbs. Another common example is the lighted status indicators, commonly called "idiot lights," in automotive instrument clusters. Graphics on many switches and buttons in cars also may have incandescent backlighting. However, these approaches may not be suitable when available power is limited.

Another design makes use of several clustered LEDs with a molded plastic light guide to collect and distribute the light. Alternatively, the light guide may be a simple flat diffuser. Although clustered LEDs have proven useful, for some applications, the cluster may require more power than is available. Also, such a design may require complex tooling to make the light guide and may have the potential for uneven light distribution. Finally even multiple LEDs may not be visible in daylight.

A third option is to use a single LED exposed on a front surface of a device. There are many examples of a single LED design in common electronic products such as telephones, VCRs, stereos, and personal computers. These devices are often meant primarily for indoor use. While using a single LED may satisfy a requirement for low power usage, a single LED may not be visible in daylight, the colors are limited to those available from LED manufacturers, the design precludes backlighted graphics and will not, in general, be weather resistant.

Thus there remains a need for a backlighted indicator for outdoor use, visible in daylight, that has low power requirements.

SUMMARY

A single LED combined with a dark-colored reflective cavity, a diffusing graphic overlay, and a dark tinted window, provides a backlighted indicator with low power requirements. The design exhibits high visual contrast between on and off conditions, giving daylight visibility. The diffusing overlay and the window are nested and individually attached to a housing with adhesives, thus providing a double barrier against liquid penetration. Thus, the indicator can be used outdoors and under conditions of limited power. For example, the indicator may be part of a customer terminal mounted outdoors at retail establishments, such as gasoline stations.

DETAILED DESCRIPTION

Figure 1:
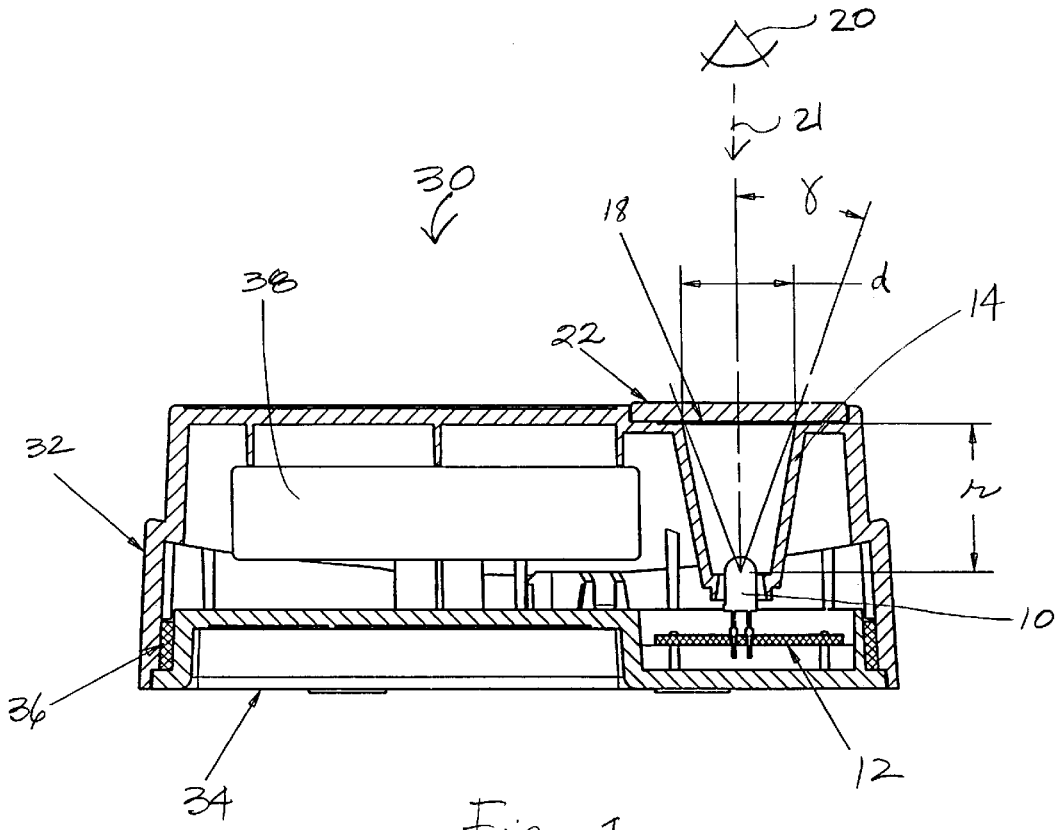
FIG. 1 is a cross section, along section lines B—B of FIG. 2, of a unit containing a backlighted indicator according to an embodiment of the present invention.

An indicator visible in daylight while requiring only low power consumption is illustrated in FIG. 1. The indicator includes a single light emitting diode (LED) 10 attached to a printed circuit board assembly (PCBA) 12 and extending into a dark-colored reflective cavity 14. The reflective cavity 14 has the shape of a truncated cone, the LED extending into the truncated end. Alternatively, the reflective cavity may have other shapes, such as cylindrical or paraboloidal. The indicator also includes a diffusing graphic overlay 18, which is a layer of diffusing material, typically having printed graphics, and a dark tinted window 22. The diameter d, on the diffusing overlay, illuminated by LED 10, is determined by the LED dispersion half-angle $\gamma$, and a distance r between overlay 18 and LED 10. When an LED with a dispersion half-angle $\gamma$ of 20° is used, a distance r of between about 25 and 30 mm will allow LED 10 to illuminate an area with diameter d of about 18 mm on overlay 18. With this design, the indicator diameter, d, that is the illuminated area on the overlay, is much larger than the diameter of the LED, which is typically about 5 mm. In FIG. 1, a viewer 20 observes the indicator by looking in direction 21. The graphic overlay 18 is backlighted, since the light source 10 is on the opposite side of the overlay 18 from the viewer 20.

In one implementation, a "super bright" type LED, for example the T1-3/4 LED, No. NSPW500BS, provided by Nichia Chemical Industries, Ltd., Tokushima, Japan is used for LED 10. These LEDs typically require less than 100 milliwatts of power and need to be powered only when the indicator light is on. The T1-3/4 LED, for example, requires 20 milliamps at 3.6 volts, or 72 mw of power.

Diffusing overlay 18 may be made of textured polycarbonate film, such as Lexan 8B35 provided by General Electric Structured Products, Pittsfield, Mass. The diffusing texture assures an even illumination over the entire diameter d on the surface of overlay 18. The overlay is typically clear except for the graphics. The graphics may use unlimited colors if used with an LED of compatible color, typically a "white light", that is full spectrum, LED, such as the "super bright" LED specified above. The graphics can be printed using translucent inks for good color clarity, since the graphics are backlighted. The dark tinted window 22, which may be a lens, is typically made of molded acrylic, such as Plexiglas V920 provided by Elf-Atochem North America, Philadelphia, Pa., compounded with appropriate tinting agents. The dark window provides limited transmission of visible light. It has been found that a window with a transmission of visible light of between about 20% and about 30% satisfies the conflicting goals of hiding the presence of the indicator when the LED is off and transmitting sufficient light when the LED is on. Tinting agents of any color may be used. However, a neutral gray tinting agent has the benefit of being compatible with graphics of all colors.

Reflective cavity 14 has a highly polished dark surface, typically either black or dark gray, which enables it to perform three functions. First, the reflective cavity re-reflects any light from LED 10 that is back-scattered by specular reflection from overlay 18, thus maximizing the light directed out toward the viewer 20. Second, the reflective cavity provides a uniform lighted background for the graphics on overlay 18, which provides a wide practical viewing angle. Using cavity 14, the indicator can be viewed from greater than 60 degrees off axis. Without a reflective cavity, the practical viewing angle would be limited to little more than the dispersion angle of the LED. The third function of the reflective cavity is to provide a uniform dark background when the indicator is off.

Thus, the dark-tinted window and the dark-colored reflector make the entire window appear opaque when the indicator is off. In this case, the overlay graphics become hidden from view. The combination of the diffusing overlay, reflecting cavity and appropriate selection of distance r give optimum light dispersion with minimal loss when LED 10 is on. While the absolute luminous energy of the combination of LED 10, overlay 18, and window 22 is less than the energy of LED 10 alone, the visual contrast between the off and on states provides daylight visibility. The design of the backlighted indicator includes only a small number of parts that are easily assembled and do not require critical alignment. Thus, the indicator can be built at low cost.

In an alternative arrangement, the indicator also includes a lens (not shown) between the LED 10 and overlay 18, where the lens effectively increases the dispersion angle y. Including such a lens would allow the distance r to be reduced without reducing the image size d, resulting in a thinner indicator.

Figure 2:
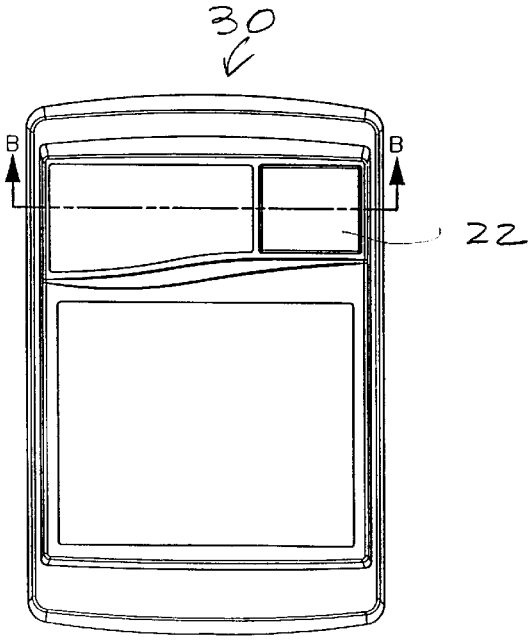
FIG. 2 is a front view of the unit containing a backlighted indicator, according to an embodiment of the present invention.
Figure 3:
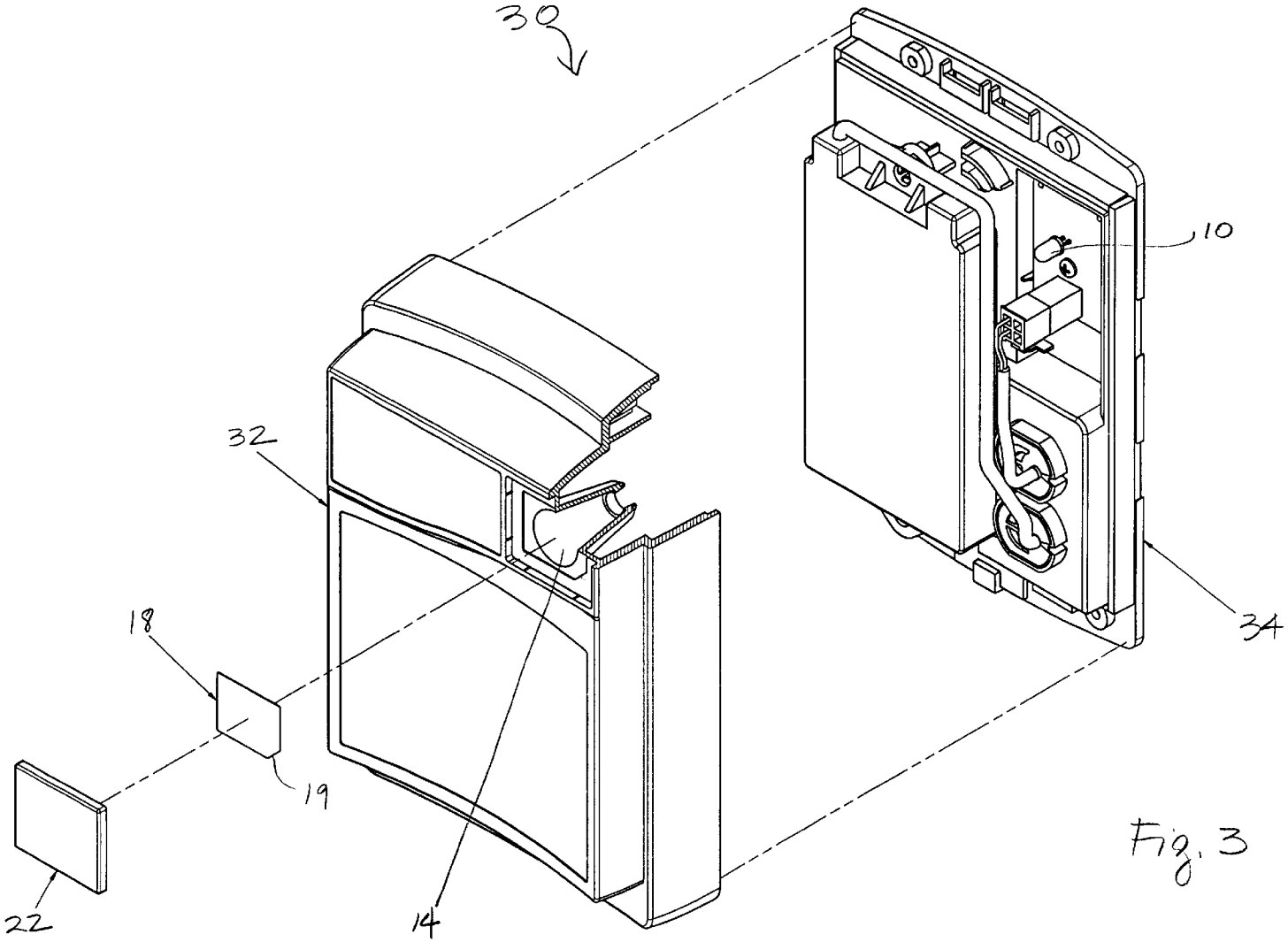
FIG. 3 is a partially exploded view of the unit of FIGS. 1 and 2.

FIG. 1 shows the backlighted indicator as part of a unit 30 that may be used as a customer terminal, as explained more fully below. A front view of unit 30 is shown in FIG. 2. Unit 30 includes a front cover 32 and a rear cover 34. Gaskets 36 are interposed between front cover 32 and rear cover 34, forming a waterproof seal. In FIG. 1, dark colored reflective cavity 14 is integral with front cover 32. Cavity 14 can alternatively be separate from front cover 32; however, an integral construction advantageously requires fewer parts and assembly steps. Diffusing overlay 18 and tinted window 22 are nested and attached individually to front cover 32 with adhesives. The arrangement of overlay 18 and window 22 is further illustrated in the partially exploded view of FIG. 3, in which a corner of the front cover is depicted as removed to show the conical shape of reflective cavity 14. The shape of diffusing overlay 18, as depicted in FIG. 3, has a chamfered corner 19 to ensure that the overlay is mounted in cover 32 such that the graphic is displayed in the desired orientation. Diffusing overlay 18 may alternatively be formed in other shapes, preferably providing a preferred orientation. Although a waterproof construction is possible using adhesive only on window 22, attaching the overlay and window individually provides a double barrier against penetration by liquids. Thus, unit 30 is weatherproof for outdoor use. Use of the graphic overlay separate from the window facilitates providing variants of the indicator with different graphics.

One application of unit 30 is as a customer terminal at a gasoline station, or at any retail operation at which purchases are made outdoors. At some time before a purchase is to be made using unit 30, a customer has encoded credit card information in a small portable token, typically termed a key fob, because it is expected to be kept on a customer's key ring. The information is stored in the key fob in non-volatile random access memory (RAM). The device used to record the key fob is based on familiar credit card slide readers. For example, a VeriFone model RF350 contactless smart card reader and writer, provided by the VeriFone Division of Hewlett-Packard, Santa Clara, Calif., is used to encode credit card information on the key fob.

A customer desiring to make a purchase holds the key fob in front of unit 30. Unit 30 contains an antenna 38, which is connected by up to 100 feet of coaxial cable to a controller unit (not shown), mounted separately. An antenna and controller unit combination is described, for example, in U.S. Pat. No. 5,241,160, and is available commercially from On Track Innovations Ltd., Hevel Tefen, Israel. The controller constantly emits radio frequency (RF) radiation via the antenna. The key fob contains an RF transponder powered by inductively coupled radiation from antenna 38 enabling the controller to read the information encoded in the key fob. When the fob is read successfully, the controller provides power via a 2-conductor wire to the indicator. The indicator light turns on to indicate to the customer that the key fob was read. The controller sends the credit card information read from the key fob to a point-of-sale (POS) system which authorizes the transaction and, in the case of a gasoline station, activates the pump.

Because of the low power requirements, the unit is suitable for use in Class I, Division 2 hazardous locations as defined by the National Electrical Code, where voltage and current must be limited. An example of such a location is around the fuel dispensers at gasoline stations. The key fob and customer terminal concept are attractive to retailers interested in building customer loyalty as the key fobs can be designed to be valid at a particular location or chain. Furthermore, the indicator graphics are easily and inexpensively customizable, by changing the artwork on diffusing graphic overlay 18, making it simple to include a recognizable logo in overlay 18.

Although the invention has been described with reference to use of a backlighted indicator in a customer terminal application, the description is only an example of the invention's application and should not be taken as a limitation. The backlighted indicator is effectively used wherever power is limited, for example, in portable, battery operated devices. Various adaptations and combinations of features of the examples disclosed are within the scope of the invention as defined by the following claims.

I claim:

1. A backlighted indicator comprising:

a dark-colored reflective cavity comprising a cavity surrounded by a dark-colored reflective surface;

a single light emitting diode mounted in a first end of the reflective cavity and configured to generate an LED light output through the cavity;

a layer of diffusing material proximate to a second end of the reflective cavity opposite the light emitting diode, the layer including a clear portion; and a dark tinted window proximate to the layer of diffusing material;

wherein the reflective cavity reflects LED light output that is back-scattered by specular reflection from the layer of diffusing material, provides uniform lighted background for a graphics image in the layer of diffusing material, and provides a uniform dark background to make the window appear as opaque when the LED light output is not generated.

2. The indicator of claim 1 wherein the reflective cavity has the shape of a truncated cone with a truncated end and the light emitting diode is mounted in the truncated end of the cavity.

3. The indicator of claim 1 wherein the layer of diffusing material comprises a graphic image and wherein the layer of diffusing material is backlighted by the LED light output from the light emitting diode.

4. The indicator of claim 3 wherein the graphic image comprises multiple colors.

5. The indicator of claim 1 wherein when power is supplied to the light emitting diode, the light emitting diode illuminates an area on the layer of diffusing material that is larger in diameter than a diameter of the light emitting diode.

6. The indicator of claim 1 wherein a size of the area on the layer of diffusing material illuminated by the light emitting diode is determined by a dispersion half angle of the light emitting diode, and a distance between the light emitting diode and the layer of diffusing material.

7. The indicator of claim 1 wherein the contrast between the appearance of the indicator when power is supplied to the light emitting diode and when power is not supplied to the light emitting diode is observable to a viewer observing the window in daylight.

8. The indicator of claim 1 wherein the light emitting diode requires less than about 100 milliwatts of power.

9. The indicator of claim 1 wherein the indicator is mounted in a housing and wherein the layer of diffusing material is attached to the housing with adhesive and the window is attached to the housing with adhesive.

10. The indicator of claim 3 wherein the reflective cavity provides a uniform lighted background for the graphic image whereby a viewing angle of the indicator is greater than a half dispersion angle of the light emitting diode.

11. The indicator of claim 1 wherein a transmission of the window for the visible light is between about 20% and about 30%.

12. The indicator of claim 1, further comprising:

a lens disposed between the light emitting diode and the layer of diffusing material.

13. The indicator of claim 1, further comprising:

a printed circuit board assembly attached to the light emitting diode.

14. The indicator of claim 1, wherein the layer of diffusing material and the dark tinted window are attached individually to a customer terminal to provide a double barrier against liquid penetration.

15. The indicator of claim 1, wherein the dark-colored reflective cavity is integral to a front cover of a customer terminal.

16. The indicator of claim 1, wherein the dark-colored reflective cavity is attached to a customer terminal.

17. A customer terminal comprising:

an antenna coupled to the controller unit, the antenna configured to receive signals from a device external to the terminal; and an indicator-coupled to the controller unit, wherein the indicator is activated in response to a signal from the controller unit, the indicator comprising:

a dark-colored reflective cavity comprising a cavity surrounded by a dark-colored reflective surface;

a single light emitting diode mounted in a first end of the reflective cavity and configured to generate an LED light output through the cavity;

a layer of diffusing material proximate to a second end of the reflective cavity opposite the light emitting diode, the layer including a clear portion; and a dark tinted window over the layer of diffusing material;

wherein the reflective cavity reflects LED light output that is back-scattered by specular reflection from the layer of diffusing material, provides uniform lighted background for a graphics image in the layer of diffusing material, and provides a uniform dark background to make the window appear as opaque when the LED light output is not generated.

18. The terminal of claim 17 wherein the reflective cavity has the shape of a truncated cone with a truncated end and the light emitting diode is mounted in the truncated end of the cavity.

19. The terminal of claim 17 wherein the layer of diffusing material comprises a graphic image and wherein the layer of diffusing material is backlighted by the LED light output from the light emitting diode.

20. The terminal of claim 19 wherein the graphic image comprises multiple colors.

21. The terminal of claim 1 wherein when the indicator is activated, the light emitting diode illuminates an area on the layer of diffusing material that is larger in diameter than a diameter of the light emitting diode.

22. The terminal of claim 17 wherein a size of the area on the layer of diffusing material illuminated by the light emitting diode is determined by a dispersion half angle of the light emitting diode, and a distance between the light emitting diode and the layer of diffusing material.

23. The terminal of claim 17 wherein the contrast between the appearance of the indicator when the indicator is activated and when the indicator is not activated is observable to a viewer observing the window in daylight.

24. The terminal of claim 17 wherein the light emitting diode requires less than about 100 milliwatts of power.

25. The terminal of claim 17 wherein the layer of diffusing material is attached to a front cover of the terminal with adhesive and the window is attached to a front cover of the terminal with adhesive.

26. The terminal of claim 19 wherein the reflective cavity provides a uniform lighted background for the graphic image whereby the viewing angle of the indicator is greater than a half dispersion angle of the light emitting diode.

27. The indicator of claim 17 wherein the transmission of the window for visible light is between about 20% and about 30%.

28. The terminal of claim 17, further comprising:

a lens disposed between the light emitting diode and the layer of diffusing material.

29. The terminal of claim 17 further comprising:

a printed circuit board assembly attached to the light emitting diode.

30. The terminal of claim 17, wherein the layer of diffusing material and the dark tinted window are attached individually to the customer terminal to provide a double barrier against liquid penetration.

31. The terminal of claim 17, wherein the dark-colored reflective cavity is integral to a front cover of the customer terminal.

32. The indicator of claim 17, wherein the dark-colored reflective cavity is attached to the customer terminal.

* * * * *